US007624798B2

(12) United States Patent
Presslie et al.

(10) Patent No.: US 7,624,798 B2
(45) Date of Patent: Dec. 1, 2009

(54) CENTRALIZER FOR EXPANDABLE TUBULARS

(75) Inventors: Mark W. Presslie, Aberdeenshire (GB); William J. Hay, Aberdeen (GB)

(73) Assignee: Baker Hughes Incorporated, Houston, TX (US)

( * ) Notice: Subject to any disclaimer, the term of this patent is extended or adjusted under 35 U.S.C. 154(b) by 225 days.

(21) Appl. No.: 11/438,729

(22) Filed: May 22, 2006

(65) Prior Publication Data

US 2006/0266516 A1 Nov. 30, 2006

Related U.S. Application Data

(60) Provisional application No. 60/685,682, filed on May 27, 2005.

(51) Int. Cl.
*E21B 17/10* (2006.01)

(52) U.S. Cl. ..... 166/241.7; 166/241.1; 166/207; 166/206; 175/325.5

(58) Field of Classification Search ..... 166/380, 166/207, 241.1, 241.6, 241.7, 206; 175/325.5
See application file for complete search history.

(56) References Cited

U.S. PATENT DOCUMENTS 2,611,664 A 9/1952 Kothny
2,812,025 A 11/1957 Teague et al.
2,874,783 A 2/1959 Haines
2,931,440 A 4/1960 Lebourg
3,528,499 A 9/1970 Collett
3,578,084 A 5/1971 Bombardieri et al.
3,746,092 A * 7/1973 Land ..... 166/207
3,963,075 A 6/1976 Evans
4,088,185 A 5/1978 Carson
4,483,395 A * 11/1984 Kramer et al. ..... 166/241.6
4,641,776 A 2/1987 Vlasek et al.
4,693,328 A 9/1987 Furse et al.
5,165,478 A 11/1992 Wilson
5,224,556 A 7/1993 Wilson et al.
5,228,518 A 7/1993 Wilson et al.
5,346,016 A 9/1994 Wilson et al.
5,348,095 A 9/1994 Worrall et al.
5,379,838 A 1/1995 Wilson et al.
5,566,754 A 10/1996 Stokka
5,765,640 A 6/1998 Milne et al.
5,785,125 A 7/1998 Royer
5,908,072 A 6/1999 Hawkins
6,095,242 A 8/2000 Lequang et al.
6,102,118 A 8/2000 Moore (Continued)

FOREIGN PATENT DOCUMENTS

DE 1187567 2/1965

(Continued)

*Primary Examiner*—Jennifer H Gay
*Assistant Examiner*—Cathleen R Hutchins
(74) *Attorney, Agent, or Firm*—Steve Rosenblatt

(57) ABSTRACT

A multi part centralizer can be secured quickly to tubular to be cemented and expanded in a deviated wellbore. The segments ratchet with respect to each other and are capable of holding the centralizer snug against the tubular for delivery downhole and cementing. After cementing the expansion of the tubular is not significantly resisted by the centralizer as its diameter increases with the expanded tubular below it. The end position after expansion is held due to the ratchet feature insuring the fixation of the centralizer as the cement sets.

7 Claims, 1 Drawing Sheet

U.S. PATENT DOCUMENTS

| | | | | |
|---|---|---|---|---|
| 6,112,813 | A | 9/2000 | Head | |
| 6,112,818 | A | 9/2000 | Campbell | |
| 6,283,205 | B1 | 9/2001 | Cannon | |
| 6,315,497 | B1 | 11/2001 | Wittman et al. | |
| 6,367,556 | B1 | 4/2002 | Moore | |
| 6,435,275 | B1 | 8/2002 | Kirk et al. | |
| 6,457,519 | B1 | 10/2002 | Buytaert | |
| 6,513,223 | B1 | 2/2003 | Angman et al. | |
| 6,543,545 | B1 | 4/2003 | Chatterji et al. | |
| 6,561,271 | B2 | 5/2003 | Baugh et al. | |
| 6,564,870 | B1 | 5/2003 | Grigsby et al. | |
| 6,595,284 | B2 * | 7/2003 | Davis | 166/241.4 |
| 6,695,054 | B2 * | 2/2004 | Johnson et al. | 166/278 |
| 6,725,939 | B2 | 4/2004 | Richard | |
| 2001/0037882 | A1 * | 11/2001 | Linaker | 166/241.1 |
| 2003/0047322 | A1 | 3/2003 | Maguire et al. | |
| 2003/0106719 | A1 | 6/2003 | Herrera | |
| 2003/0150611 | A1 | 8/2003 | Buytaert | |
| 2003/0164236 | A1 | 9/2003 | Thornton | |
| 2004/0173349 | A1 * | 9/2004 | Pointing | 166/241.6 |
| 2004/0182571 | A1 * | 9/2004 | Betts | 166/241.6 |
| 2005/0224227 | A1 * | 10/2005 | Hendrie | 166/241.6 |
| 2006/0266514 | A1 * | 11/2006 | Abarca et al. | 166/118 |

FOREIGN PATENT DOCUMENTS

| | | | |
|---|---|---|---|
| GB | 2345308 | A | 7/2000 |
| WO | WO 94/13928 | | 6/1994 |
| WO | WO 02/10550 | A1 | 2/2002 |
| WO | WO 02/25056 | A1 | 3/2002 |

* cited by examiner

CENTRALIZER FOR EXPANDABLE TUBULARS

PRIORITY INFORMATION

This application claims the benefit of U.S. Provisional Application No. 60/685,682, filed on May 27, 2005.

FIELD OF THE INVENTION

The field of the invention is centralizers that are used in conjunction with tubulars that are to be expanded downhole.

BACKGROUND OF THE INVENTION

Centralizers have been in use for a long time. As their name suggests they have been used to center a tubular in a borehole. Most commonly, centralizers are used to position casing in the borehole as the cement is delivered into the annular space around the outside of the casing to set up and seal the casing in the bore hole. Centralizers have also been used as guides for sucker rods in downhole pumps. The centralizers have been made of metal and non-metallic materials such as thermoplastic polyamides, glass and mineral filled nylons and poly-tetra fluoro ethylene, also known as Teflon and injection molded polyurethane. These centralizers were made in hinged segments that could be clamped onto a tubular and in some applications the centralizers were formed right on to or slipped over the rod or tubular. Illustrative examples of the variations in prior centralizers are shown in U.S. Pat. Nos. 4,483,395; 4,088,185; 3,963,075; 2,611,664; 5,908,072; 6,102,118; and 6,283,205.

More recently, tubulars such as casing have been expanded downhole after cementing and sometimes without cementing. The centralizers used on casing for expansion have been metallic and have caused problems. Recently, one such problem has been reported in the March 2002 issue of Drilling Magazine on page 36. There a tempered steel arm of a centralizer had broken off and damaged the pipe to be expanded. The problem is that if the pipe to be expanded is scored prior to expansion, the stress is concentrated at that area and a fracture is likely upon expansion. There has been some recognition of this concern in the way the expandable tubulars are handled on the surface. Expandable tubulars are picked up with forklifts that have padded forks. The joints are packaged with wooden dividers to avoid contact with each other. Nylon slings are used to pick up joints one at a time onto the rig. Non-penetrating tongs are used to get a friction grip on the connections during makeup. Despite all these surface handling precautions, metallic centralizers have continued to be used. These centralizers are sufficiently rigid to increase the force required on the swage for expansion downhole. At times, the swage has stalled as the stroker has tried to advance it in the location of a relatively unyielding centralizer. Occasionally, the metallic centralizers used on casing to be expanded have had flexible strips break during run in and have scored the outer surface of the casing to the point that when the casing was expanded the stress concentration at the point of scoring initiated a fracture failure during expansion.

When cementing a tubular, centralizers have been used to allow the cement to work its way fully around the tubular. Without centralizers, particularly if there is a deviation in the wellbore, there was a risk that the tubular would lay up against the borehole wall on the low side undermining the benefit of the cement in trying to seal around the tubular.

Centralizers of various types have been used in the past. The most common centralizers comprise a plurality of spaced flexible strips that extend longitudinally between a pair of end rings. The centralizers are slipped over the end of the tubular on makeup or get clamped to the tubular due to a hinge connection in each of the two end rings. These centralizers are typically made of steel. The problem with these centralizers arises if there is to be any pipe expansion. Expanding tubulars has become a more widely used procedure and such centralizers have been known to cause high stress areas on the underlying tubular during expansion to the point where the tubular can split or crack. Attempts to improve on the metal centralizers described above by making them from a polymeric material have had mixed results. The problem there has been that they are not strong enough to hold their shape to the extent that their main purpose of centralizing is defeated. Also, their geometric dimensions do not lend themselves to be run through the previous casing string and yet still have enough standoff for suitable centralization.

Centralizing devices have also been used that are bulky and that have many moving parts. These designs are expensive, require inordinate maintenance, and are simply too large to be of use in many applications. Some examples are U.S. Pat. No. 2,874,783 and PCT Application WO 94/13928.

Another centralizing technique for cementing tubulars has been to use telescoping cylinders that can be pushed out when the tubular is in position. These cylinders had removable barriers to let flow go through them after extension. One of their uses was to centralize a tubular prior to cementing. Some illustrations of this type of centralizing. system can be found in U.S. Pat. Nos. 5,228,518; 5,346,016; 5,379,838; 5,224,556; and 5,165,478. None of these centralizers were used in combination with tubulars that were to be expanded. Yet, despite the use of extendable cylinders to centralize prior to cementing, in applications where the tubular was to be expanded after cementing there was either no attempt to cement in an inclined wellbore or centralizers that wrapped around the tubular and caused stress failures when expanded were used. As a result, poor cement distribution occurred that was compounded by the subsequent expansion of the tubular. What is needed and addressed by the present invention is an effective way to centralize a tubular before it is cemented and subsequently expanded even if it is disposed in a deviated bore.

Apart from the various deign described above, in the context of tubular to be expanded in deviated borehole after being cemented, rubber strips were used in a helical pattern that extended from a ring that was bonded to the outside of the tubular with the strips extending generally longitudinally. These designs did not substantially resist expansion as the bow spring centralizers but they were logistically complicated in that the tubulars had to be shipped to a shop capable of bonding the rubber strips and ring to the tubing outer surface and the strips were also prone to being rubbed or tom off during delivery in a deviated wellbore.

What is needed and addressed by the present invention is a centralizer that can be quickly installed without having the tubulars delivered to a specialized facility. The centralizer can then be fitted to the tubular and function to centralize in a deviated wellbore for cementing while not providing meaningful resistance to expansion of the tubular. The centralizer can incorporate a mechanism to allow expansion and retain a secured initial position for delivery and cementing and maintain a secured post expanded position. These and other features of the present invention will become more apparent to those skilled in the art from a review of the description of the preferred embodiment and the drawings associated with it, recognizing that the full scope of the invention is illustrated in the appended claims.

SUMMARY OF THE INVENTION

A multi part centralizer can be secured quickly to tubular to be cemented and expanded in a deviated wellbore. The segments ratchet with respect to each other and are capable of holding the centralizer snug against the tubular for delivery downhole and cementing. After cementing the expansion of the tubular is not significantly resisted by the centralizer as its diameter increases with the expanded tubular below it. The end position after expansion is held due to the ratchet feature insuring the fixation of the centralizer as the cement sets.

DETAILED DESCRIPTION OF THE DRAWINGS

DETAILED DESCRIPTION OF THE PREFERRED EMBODIMENT

Figure 1:
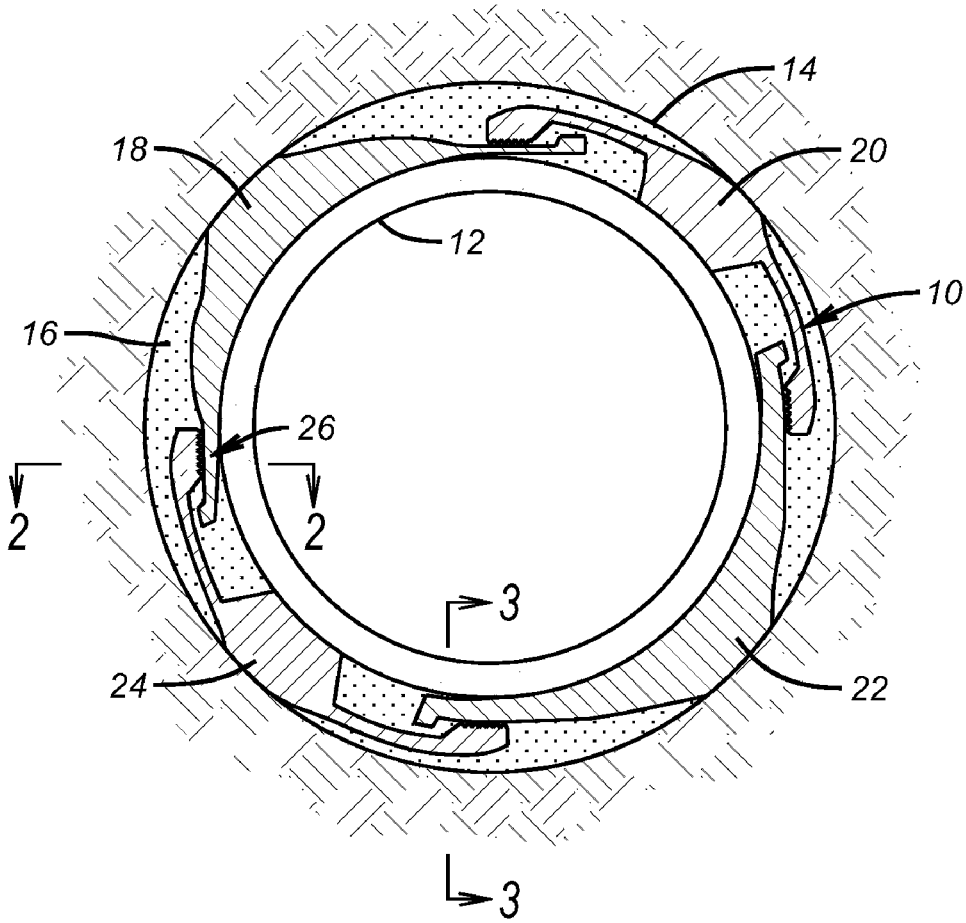
FIG. 1 is a section view showing the multipart centralizer.

FIG. 1 illustrates the centralizer 10 shown in a section view. The centralizer 10 is slipped over a tubular 12 and the assembly is inserted in a deviated wellbore 14. The deviated nature of the wellbore 14 makes centralizer 10 necessary to properly position the tubular 12 in the borehole 14 so that cement 16 can effectively go all around tubular 12. In FIG. 1, four segments 18, 20, 22, and 24 are illustrated but those skilled in the art will appreciate that any number of segments can be used down to a single split ring design having a closure as will be described below.

The connection between segments such as 18 and 20 can be a repeated design that connects the remaining segments or differences can be incorporated depending on the circumstances. In general terms, before describing any specific design, it is desirable that the segments hold a position relative to each other for run in. Additionally, for assembly purposes before run in, it would be advantageous to be able to assemble a segment to its adjacent segment quickly. In that manner the centralizers can be mounted to the tubular 12 on site to minimize transit damage and shipping cost embodied in prior designs that required tubulars to be shipped to a specialty shop to bond rubber ribbed sleeves to the outer tubular surface.

Figure 2:
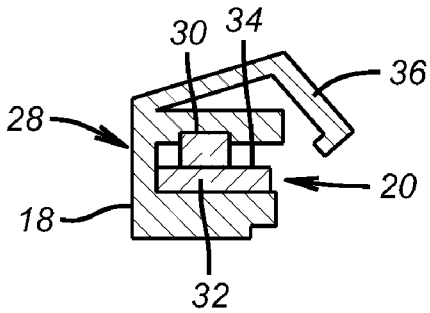
FIG. 2 is a detail of the ratchet mechanism between segments during the assembly of the segments to the underlying tubular and taken along line 2-2 of FIG. 1.

In one embodiment the segments can ratchet over each other to make the centralizer 10 sit snugly on the tubular 12 for rapid assembly and a snug fit for run in to minimize shifting longitudinally. FIG. 2 shows how this rapid assembly can be accomplished as the closure 36 is left open as the centralizer 10 has its segments brought together for a snug fit on the tubular 12. The connection 26 can function to allow relative movement between adjacent segments in one direction while keeping the centralizer 10 snug against the tubular 12. When expansion occurs of the tubular 12 the ratchet will allow the relative position between segments to shift and the assembly that comprises centralizer 10 will simply be increased in size along with the tubular 12 that is expanded from within. The centralizer 10 will still be snug to the tubular 12 even after the expansion.

Figure 3:
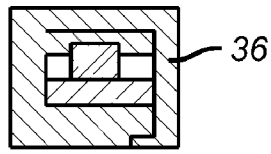
FIG. 3 is the view of FIG. 2 with the ratchet mechanism fully assembled and taken along line 3-3 of FIG. 1.

FIGS. 2 and 3 show how this can be done at a typical connection between a pair of segments. A housing 28 includes a pawl or latch 30. The housing 28 can be integrated with one segment like 18 and the adjacent segment 20 has a tab 32 running under the pawl 30. Wickers or a ratchet 34 is on tab 32 and contacts the pawl 30. Once an initial position is defined between segments 18 and 20 for example, the closure 36 is snapped to housing 28 to hold the relative position of the ratchet 34 against the pawl 30. The overall inside diameter of the centralizer 10 is now reduced to secure a snug fit on the tubular 12. The pawl 30 simply allows the segments 18 and 20 to shift with respect to each other while maintaining a grip on the tubular 12 as its dimension is increased by expansion form within.

Those skilled in the art will appreciate that a centralizer design is contemplated that can be quickly mounted to a tubular and stay in position during the trip downhole. When it comes time to expand the tubular 12 the centralizer 10 will grow with it with a ratchet pawl assembly that permits such dimensional increase while keeping the centralizer 10 snug against the tubular 12. The centralizer can be one piece C shape that can be closed around a tubular with a ratchet system or other closure that hold snug for run in and then accommodates expansion of the tubular 12. What is also contemplated is some easy to make connection to secure the centralizer 10 such as a snap or other catch that can release or be overcome on expansion of the tubular 12 in conjunction with another securing feature that accommodates dimensional increase of the centralizer 10 while retaining it against the expanding tubular inside it.

The above description is illustrative of the preferred embodiment and many modifications may be made by those skilled in the art without departing from the invention whose scope is to be determined from the literal and equivalent scope of the claims below:

We claim:

1. A centralizer for a tubular for downhole use, comprising:

a plurality of connected elements capable of relative movement capable of remaining snug against a tubular during run in and growing with the tubular as it is expanded to remain snug against the tubular during expansion of the tubular;

said elements ratchet with respect to each other;

a pair of said elements on opposed ends engage each other to close around the tubular;

one of said elements comprises a closure tab to allow unrestricted relative movement between said pair of elements in a first position.

2. The centralizer of claim 1, wherein:

said connected elements are capable of closure once placed on the tubular.

3. The centralizer of claim 1, wherein:

said closure tab movable into a second position wherein relative movement between said pair of elements is regulated.

4. The centralizer of claim 3, wherein:

said closure tab comprises a part of a ratchet assembly in said second position.

5. The centralizer of claim 4, wherein:

all remaining elements are connected by a ratchet connection for relative movement between them.

6. The centralizer of claim 4, wherein:

at least one other pair of said elements is connected by a ratchet to allow relative movement between them.

7. The centralizer of claim 1, wherein:

said ratchet allows dimensional growth of said elements with respect to each other as the tubular expands to keep said elements snug to the tubular.

* * * * *